US007403728B2

(12) United States Patent
Fletcher et al.

(10) Patent No.: US 7,403,728 B2
(45) Date of Patent: Jul. 22, 2008

(54) CALIBRATION APPARATUS AND METHOD FOR CHARGING UNIT OF IMAGE FORMING DEVICE

(75) Inventors: Gerald M. Fletcher, Pittsford, NY (US); John F. O'Brien, Fairport, NY (US); Bruce J. Parks, Bloomfield, NY (US); Eliud Robles-Flores, Webster, NY (US); Alfred James Claflin, Ontario, NY (US); Jerry Floyd Adams, Waterport, NY (US)

(73) Assignee: Xerox Corporation, Norwalk, CT (US)

( * ) Notice: Subject to any disclaimer, the term of this patent is extended or adjusted under 35 U.S.C. 154(b) by 229 days.

(21) Appl. No.: 11/179,731

(22) Filed: Jul. 13, 2005

(65) Prior Publication Data

US 2007/0014584 A1 Jan. 18, 2007

(51) Int. Cl.
*G03G 15/02* (2006.01)

(52) U.S. Cl. ..... 399/50; 399/171

(58) Field of Classification Search ..... 399/50, 399/170, 171
See application file for complete search history.

(56) References Cited

U.S. PATENT DOCUMENTS 2,297,691 A 10/1942 Carlson

FOREIGN PATENT DOCUMENTS

JP 54073055 A * 6/1979
JP 56021157 A * 2/1981
JP 06266247 A * 9/1994

* cited by examiner

*Primary Examiner*—David M Gray
*Assistant Examiner*—Erika J. Villaluna
(74) *Attorney, Agent, or Firm*—Oliff & Berridge, PLC

(57) ABSTRACT

System and methods may calibrate an AC rms voltage applied to a coronode of a charging device to achieve a predefined operating current at a target value of DC shield voltage. The target value of DC shield voltage may be set to be substantially below an over-voltage condition. System and methods may use a calibration routine that may determine a minimum AC voltage required to achieve the target value of DC shield voltage. Systems and methods may alternatively, or additionally, sense current and adjust the applied voltage to obtain a target current.

20 Claims, 12 Drawing Sheets

CALIBRATION APPARATUS AND METHOD FOR CHARGING UNIT OF IMAGE FORMING DEVICE

BACKGROUND

This invention relates to systems and methods for calibrating a charging unit of an image forming apparatus.

In electrophotographic printing, a photoconductive surface, often a photoconductive belt, is charged by a charging unit and then selectively exposed to image data to selectively discharge portions of the charged photoconductive surface. This forms a latent electrostatic image on the photoconductive surface. Charged toner material is applied to the latent image bearing portion of the photoconductive surface to convert the latent electrostatic image into a developed image. Finally, the developed, or toner, image is transferred to a sheet of recording medium, such as paper, by charging the backside of the paper with another charging unit to attract the toner of the developed image from the photoconductive surface to the paper. The toner of the developed image is then at least semi-permanently fixed to the sheet of recording material, such as, for example, by heating a thermoplastic toner material to fuse the toner material to the sheet of recording material. An example of this process is more fully described in U.S. Pat. No. 2,297,691 incorporated herein by reference in its entirety.

The device that performs charging of the photoconductive surface and the recording medium may be a dicorotron, which may include an insulated coronode disposed adjacent to a conductive shield and photoconductive surface. The insulated coronode may be driven by an AC signal at a voltage high enough to create a corona plasma in the area surrounding the insulated coronode. When a bias potential is applied to the conductive shield relative to the photoconductive surface, charged particles may flow through the plasma and may be applied to the photoconductive surface. The amount of charge flowing through the plasma and deposited on the photoconductive surface may thus depend on the bias voltage between the conductive shield and the photoconductive surface, as well as on the AC voltage applied to the insulated coronode.

Charge devices such as dicorotrons, scorotrons (which include a conductive grid between the coronode and the photoconductive surface) and corotrons may be located at various places along the path of the photoconductive belt through the image forming device. In particular, the charging units may be located before the exposure units of each color station in a color image forming device, as well as before the transfer station where the toner particles are transferred to the recording medium.

SUMMARY

In general, the AC voltage to be applied to the coronode and the DC current to be supplied to the photoconductive surface is a specification of the image forming device, and may be set to a specified value upon deployment in the field. Thereafter, the AC voltage of the signal applied to the dicorotron wire may not be altered.

However, aging, contamination and environmental effects may alter the effectiveness of the coronode to produce the corona plasma. For example, if the wire becomes contaminated, the wire may become relatively more resistive, such that the current does not flow as readily through the wire. Furthermore, changes in the environmental conditions of the image forming device, such as changes in atmospheric pressure and relative humidity, may affect the ability of the coronode to produce the corona plasma. Other situations that may alter the ability of a charging device to apply a charge may include replacement or adjustment of the charging unit, whereupon location of the changing unit relative to the photoconductive surface may be altered. The change in location of the charging unit may affect the total path resistivity between the conductive shield and the photoconductive surface, and therefore the amount of charge deposited.

In order for the charging unit to apply the specified charge to the photoconductive surface in the face of changes in the condition or situation of the charging unit, the image forming device may increase the voltage applied to the conductive shield. If the voltage applied to the conductive shield becomes excessive, the image forming device may issue a warning or cause an over-voltage condition, prompting a service call to service the image forming device. Such service calls result in increased expense to the owner and to the manufacturer, and increased down time of the image forming device. Therefore, in general, the image forming device may be specified to operate at a higher AC voltage than necessary, to reduce the risk of the image forming device having an over-voltage condition during its usable lifetime.

However, operating the image forming device at AC voltage levels higher than necessary may contribute to contamination problems, because highly reactive species may be formed in the plasma surrounding the coronode, which may then interact chemically with the materials in the wire. Therefore, operating the charging unit at higher AC voltage levels than needed may aggravate contamination problems and reduce the operating life of the image forming device and/or increase the frequency of service calls.

Exemplary systems and methods may provide calibration of a charging unit of an image forming device. Such systems and methods may detect whether circumstances of the device warrant increasing the AC voltage applied to, for example, coronode of the charging unit. By using such systems and methods, the image forming device may be operated at the lowest feasible AC voltage, thus minimizing or at least reducing contamination issues associated with operation at higher AC voltage levels.

Exemplary calibration systems and methods may apply a specified current between a conductive shield and a photoconductive surface, and retrieve a target, i.e., desired, DC shield voltage value, for example, from a lookup table, the value being consistent with operation at the specified current. The specified current may thus be applied at a relatively low AC voltage, and a DC shield voltage required to achieve the specified current may be measured. If the measured DC shield voltage exceeds the target voltage, the AC voltage applied to the coronode may be increased, for example, incrementally, until the target DC voltage value is achieved.

Exemplary calibration systems may include a microprocessor that executes a calibration routine, a DC voltage sensor that senses a DC voltage in a charging unit, and an AC power supply controller that applies an AC voltage to the charging unit, wherein the microprocessor increases, the AC voltage until a target value of the DC voltage is measured by the DC voltage sensor. The charging unit may be a dicorotron, for example, using a dielectric coated wire. Alternatively, the charging unit may be a scorotron or a corotron.

Exemplary calibration systems and methods may be applied to the device, for example, each day at power-up, and the device may use the calibrated value of the AC voltage until the next calibration procedure is invoked.

In various exemplary embodiments, the calibration procedure may be applied for a plurality of recording medium stocks and thicknesses, and the measured required AC voltage may be stored in a lookup table, as corresponding to a given recording medium stock or thickness. In various exemplary embodiments, an environmental condition, such as relative humidity and/or atmospheric pressure, may also be measured and stored.

It should be understood that, as described herein, current rather than voltage may be sensed and a target current may be achieved rather than a target voltage. However, for the sake of clarity and brevity, exemplary systems and methods are described only with respect to sensing voltage and achieving a target voltage, such description not being limiting.

These and other features and advantages are described in, or are apparent from, the following detailed description.

BRIEF DESCRIPTION OF THE DRAWINGS

Various exemplary details are described with reference to the following figures, wherein.

DETAILED DESCRIPTION

Systems and methods are described herein with respect to a dicorotron charging unit. However, it should be understood that such a charging unit is exemplary only, and that the systems and methods may also be applied to other types of charging units, such as scorotrons, conductive bare wire corotrons, pin corotrons, and AC biased roller charging devices. More generally, the systems and methods may be applied to any charging device which uses an AC as well as a DC voltage to apply a charge to a surface. In this disclosure, the element of the charging device that is connected to the AC voltage source is referred to as the "coronode." For example, in the case of a dicorotron, the coronode may be a thin metal wire with a thin dielectric coating such as glass. For a bare wire corotron, the coronode may be a thin metal wire. For a pin corotron, the coronode may be an array of sharp pin or a "saw" like structure. For a bias charging roller, the "coronode" may be a relatively conductive roller.

In particular, a pre-clean dicorotron and a transfer dicorotron, are described, as implemented in an image forming device. However, it should be understood that the systems and methods may be applied to any charging unit in the image forming device, such as charge/recharge units located upstream of exposure units at each color station of a color image forming device. Furthermore, the systems and methods may be applied to charging units in non-image forming applications.

Figure 1:
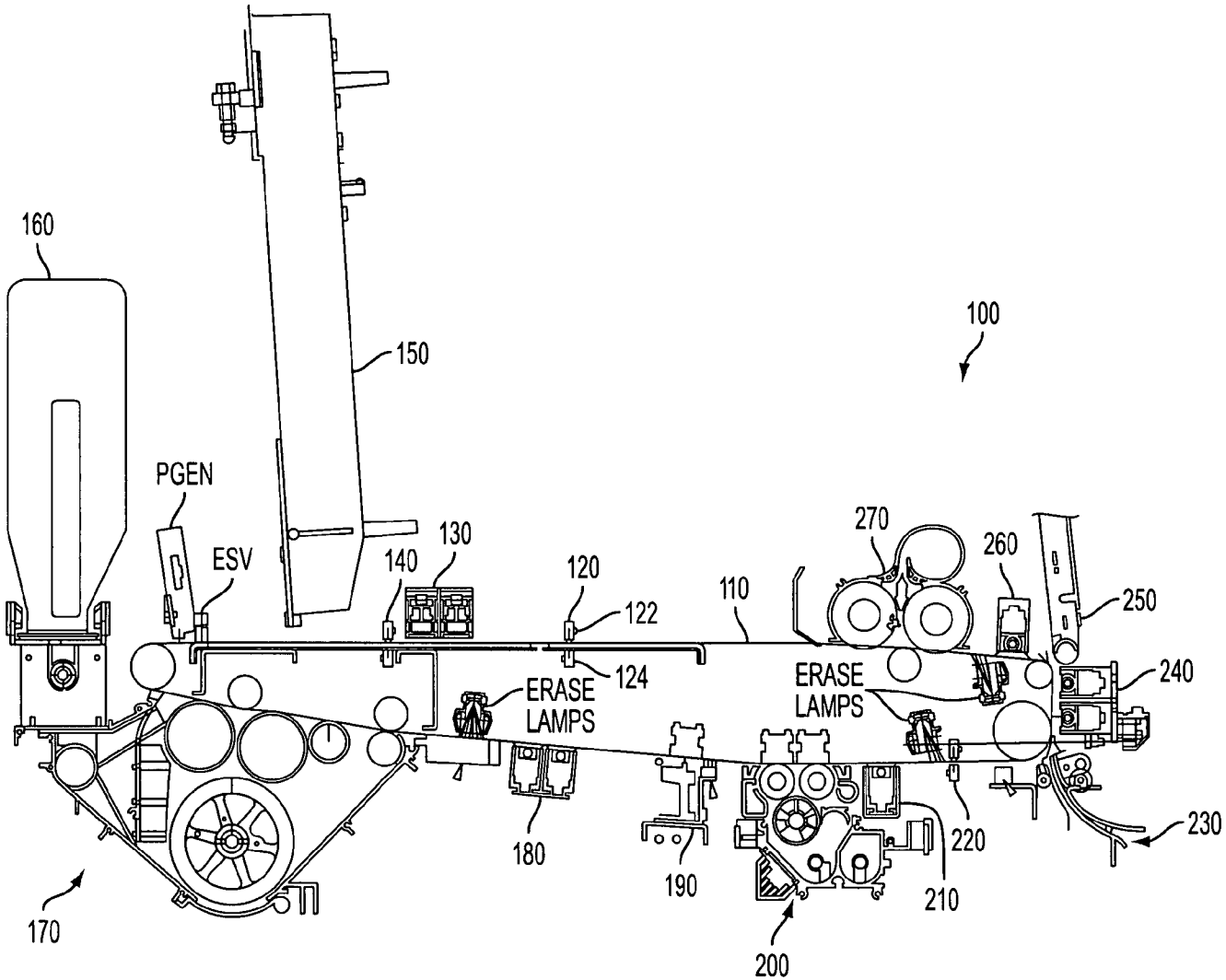
FIG. 1 is an exemplary image forming device.

FIG. 1 shows an exemplary color image forming device 100. The color image forming device 100 of FIG. 1 may be a highlight color image forming device, which applies a highlight color, in addition to black, to a recording medium such as paper. However, it should be understood that the image forming device 100 shown in FIG. 1 is exemplary only, and that the systems and methods described herein may be applied to any other known or later-developed image forming devices using charging units. The systems and methods described herein may also be applied to any device, other than image forming devices, which use charging units to apply a predefined amount of charge to a surface or object.

The image forming device of FIG. 1 may apply charge substantially uniformly across a photoconductive belt 110, for example, using a first charging unit 130. Charging unit 130 may be, for example, a dicorotron. The photoconductive belt 110 may then travel past an exposure unit which may include a raster output scanner (ROS) 150, which irradiates the photoconductive belt 110 according to a pattern corresponding to data of a document which are to be black in color. The exposed photoconductive belt 110 may then travel past a black developing unit 170, which may deposit black toner particles onto the photoconductive belt 110 in accordance with the irradiated pattern. The black toner particles may adhere electrostatically to the charged areas of the photoconductive belt 110, but not to the discharged areas.

The photoconductive belt may then travel past another charging unit 180, which may apply a substantially uniform charge across the photoconductive belt 110. The charged photoconductive belt 110 may then travel past a color exposing unit 190, which may contain light emitting diodes, for example, which may irradiate the surface of the photoconductive belt 110 according to the occurrence of color elements in the document. The exposed photoconductive belt 110 may then travel past a color developing unit 200, which may deposit color toner particles on the photoconductive belt 110 in accordance with this second irradiation. The color toner particles may adhere electrostatically to the charged areas of the photoconductive belt 110, but not to the discharged areas.

The photoconductive belt 110 may now contain black and color toner particles in areas corresponding to the black and color areas of the document. The toner may be transferred to a recording medium in a transfer station. A sheet of the recording medium, such as paper, may be taken from a paper supply 230. The backside of the sheet of paper may be charged by another charging unit 240, and the charged paper may then attract the toner particles from the photoconductive belt 110. Charging unit 240 may also be a dicorotron. The toner particles may adhere to the sheet of paper electrostatically. The paper may then be separated from the photoconductive belt 110 and transferred on a vacuum transport 250, and then to a fixing unit (not shown) which may heat the paper to fuse the toner particles to the paper. The paper may then be directed to an output bin (not shown).

The photoconductive belt 110 may then travel to a cleaning station 270, which may be preceded by a pre-clean charging unit 260. The pre-clean charging unit 260 may also be a dicorotron. The cleaning station 270 may remove residual toner particles from the belt 110 that were not transferred to the paper at the transfer station.

Figure 2:
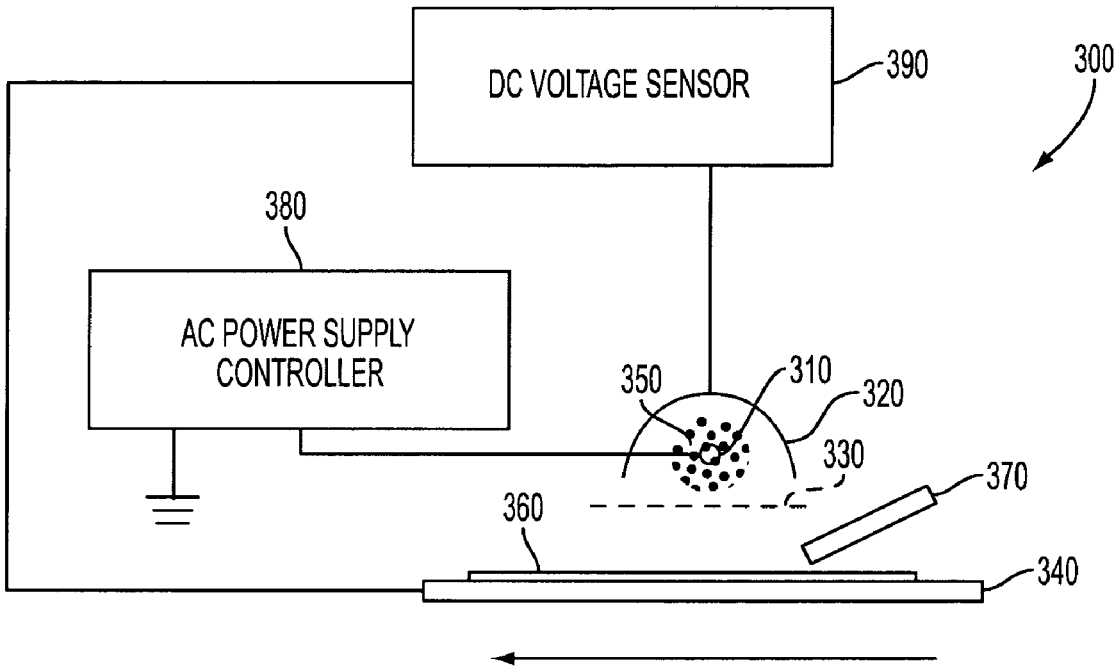
FIG. 2 illustrates an exemplary scorotron.

As noted above, each of charging units 130, 180, 240 and 260 may be dicorotrons. An exemplary charging unit 300 is shown in FIG. 2. The charging unit 300 may include a coronode 310 and a conductive shield 320, and may be disposed adjacent to a photoconductive surface 340. As previously mentioned, in dicorotrons, the coronode 310 is typically insulated by wrapping a metal wire with a dielectric material. In the case of a scorotron, a conductive grid 330 may also be placed between the coronode 310 and the photoconductive surface 340. The charging unit 300 may operate by forming a corona plasma 350 in an area surrounding the coronode 310, thereby forming a conductive path between the conductive shield 320 and the photoconductive surface 340. If a bias is applied to the conductive shield 320 relative to the photoconductive surface 340, charge flows from the conductive shield 320, through the corona plasma, to the photoconductive surface 340. In general, the amount of charge deposited by each dicorotron 130, 180, 240 and 260 may be specified during the manufacturing process for the image forming device 100.

The coronode 310 of charging unit 300 may be coupled to an AC power supply controller 380, which may provide an AC signal to the coronode 310. The conductive shield 320 may be coupled to a DC voltage sensor 390, which may measure DC voltage on the conductive shield 320. The DC voltage sensor 390 may also be equipped to measure DC current flow between the conductive shield 320 and a conductive substrate backing the photoconductive surface 340.

As the charging unit 300 ages, the coronode 310 may become contaminated, which may impede the ability of the charging device 300 to produce the corona plasma 350. In other words, the ability of the coronode 310 to produce the corona plasma 350 may change as the device 300 ages. Contamination of the coronode 310 may be accelerated by operating the charging device 300 at elevated AC rms voltage levels, as the higher voltages generate a larger concentration of reactive ionic species, which may interact chemically with metal and dielectric materials of the coronode 310.

Furthermore, if the charging unit 300 is a transfer dicorotron, such as transfer dicorotron 240, for example, a transfer assist blade 370 may be disposed adjacent to the charging unit 300. The transfer assist blade 370 may exert a mechanical pressure against the backside of a sheet of recording medium 360, for example, to enhance transfer of toner particles to the recording medium 360. However, the presence and location of the transfer assist blade 370 may affect the ability of the transfer dicorotron 240 to charge the backside of the recording medium 360.

Another factor which may affect the ability of a charging unit to charge surface is the location of the charging unit with respect to the surface. For example, if a charging unit is adjusted or replaced, its location exactly the same with respect to the charging surface, for example, as was originally intended during design or manufacture of the device 100. The charging ability of the charging unit may be affected by the precise placement of the charging unit 300 within the image forming device 100. None of these factors, the placement of the charging unit 300, the presence and location of the transfer assist blade 360, or the condition of the coronode 310 is known or compensated for after the manufacture of image forming device 100.

FIGS. 11-14 illustrate additional arrangements contemplated. Such arrangements should be understood in the context described above with respect to FIG. 2, with voltage and/or current sensed and targeted.

Figure 3:
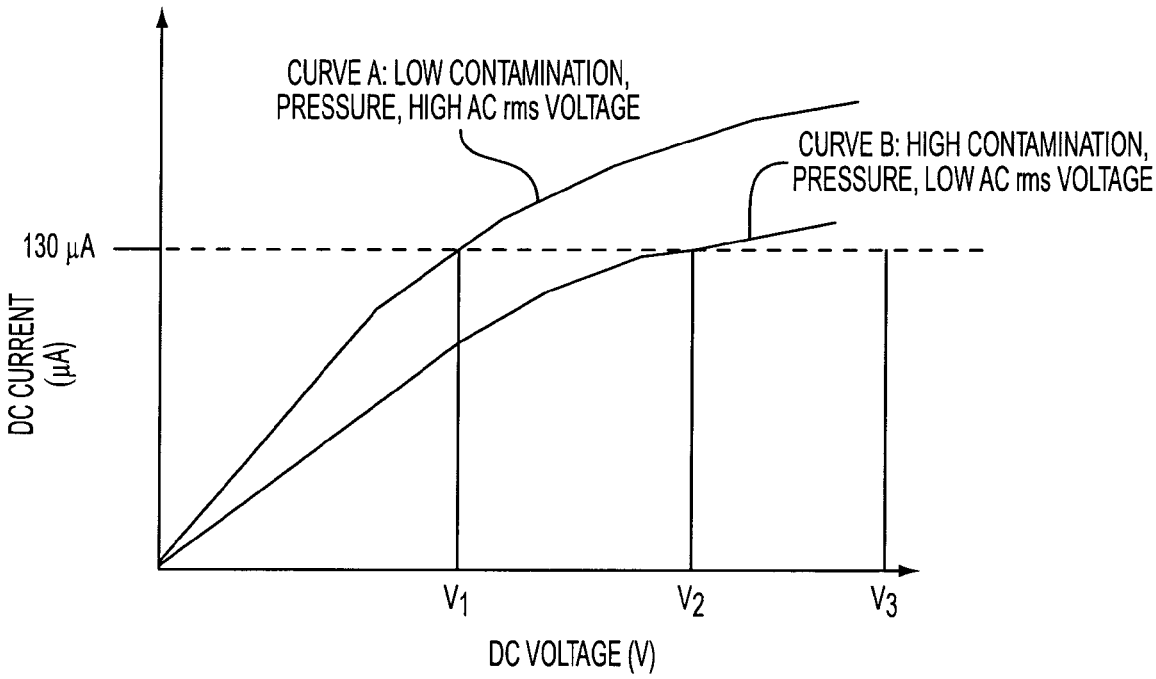
FIG. 3 is an exemplary plot of current versus voltage characteristic for the scorotron of FIG. 2.

FIG. 3 illustrates the current versus voltage relationship for an exemplary dicorotron charging unit such as that shown in FIG. 2 when a grid 330 is not present on the device in a configuration similar to that illustrated in A in FIG. 2. With a dicorotron, insignificant DC current flows from the dielectric coated wire itself and the DC current delivered by and sensed by the power supply 390 is the current that flows between the biased shield 320 and the surface 340. Below a threshold AC voltage level on the dicorotron wire, insignificant DC current flows from the device at any DC shield voltage. The threshold AC voltage level depends on many factors, such as the diameter of the coronode, the geometry of the charging device, and the environmental conditions. Above the threshold level the relationship between the DC current flowing toward the photoconductor 340 versus the DC voltage applied to the shield 320 may generally be relatively linear at low DC voltages, but may typically be quadratic or even more complex at high DC voltages. FIG. 3 also shows a nominal operating current of 130 μA for the dicorotron.

For a newly manufactured device (e.g., in pristine condition), the current versus voltage relationship may be as shown by curve "A" in FIG. 3. To produce the nominal 130 μA operating current, the DC shield voltage has to be operated at a DC shield voltage of $V_1$.

However, as described above, as the device ages, the coronode 310 may become contaminated, which may impede its ability to produce the corona plasma 350. In this situation, the current versus voltage characteristic may shift as shown by curve B in FIG. 3. For the device described by curve B to continue to provide the specified amount of current, 130 μA, to the photoconductive surface 340 or the recording medium 360, the DC shield voltage of the conductive shield 320 may be increased to a level $V_2$ by the image forming device 100. In many applications, the DC power supply senses and controls the DC current delivered toward the photoconductive surface 340 to be constant so that the level V2 will be automatically increased. If the DC shield voltage reaches a predefined threshold level $V_3$, an over voltage condition may occur in which the image forming device may cease to operate. A service call may then be required to clean or possibly to replace the coronode 310 to place the image forming device 100 back in operable condition.

In addition to contamination, changes in environmental conditions may shift the current versus voltage relationship, for example, from curve A to curve B. For example, if the atmospheric pressure conditions are low at one specific time and then change to relatively higher pressure conditions at another specific time, the current versus voltage characteristic may shift from curve A to curve B. Similarly, if the device 100 is configured for high-altitude, relatively low-pressure conditions, but is moved to sea level, the current versus voltage characteristic may shift from curve A to curve B. The image forming device 100 operating at sea level, in a relatively high-pressure condition may be operating much closer to the over-voltage condition than an image forming device operating at high-altitude, in the relatively low-pressure condition for which the device 100 is configured.

The relative humidity of the environment surrounding the image forming device 100 may also affect the current versus voltage characteristics of the image forming device 100. For example, a higher relative humidity may increase the density of ionic species in the corona plasma, which may increase the impedence of the corona plasma to current flow. Therefore, an image forming device 100 operating in low relative humidity may perform, for example, according to curve A, whereas an image forming device operating in high relative humidity may perform, for example, according to curve B.

Curves A and B shown in FIG. 3 may also reflect operation of the charging unit 300 under the same environmental conditions, but with different values of the AC voltage applied to the coronode 310. Curve A may apply to a charging unit operated at a relatively high AC voltage, such that the coronode 310 is relatively effective at producing a low impedance corona plasma 350. Similarly, curve B may correspond, for example, to a charging unit operated at relatively low AC voltage, such that coronode 310 produces a relatively high impedance plasma 350, which reduces the slope of the current versus voltage characteristic.

Figure 4:
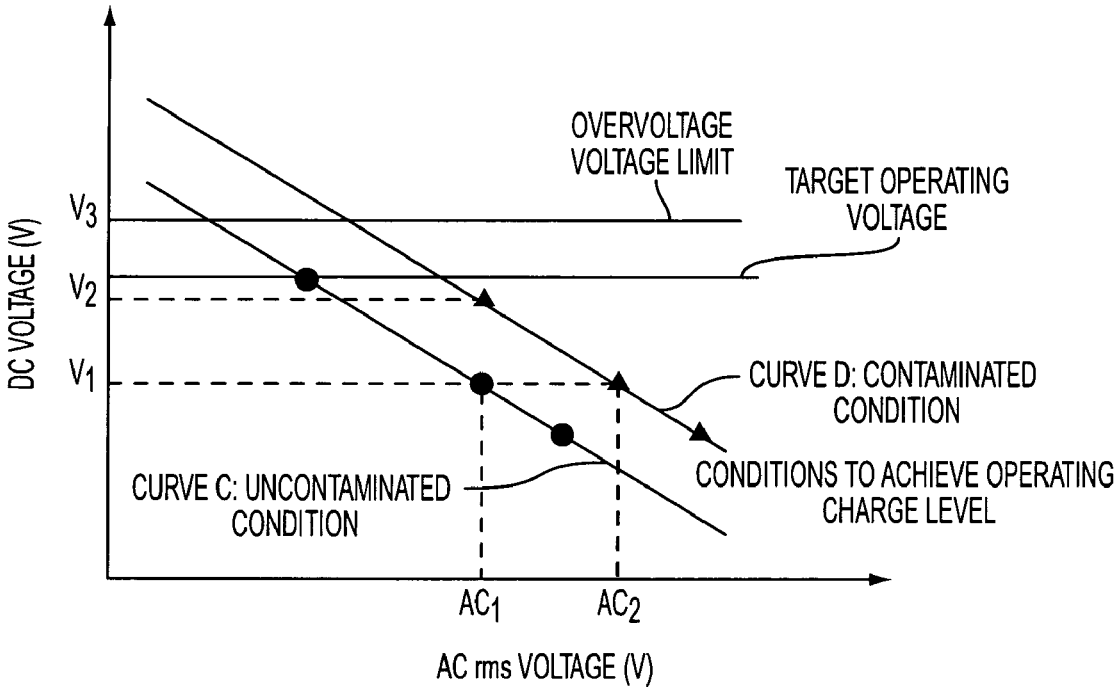
FIG. 4 shows exemplary relationships between DC shield voltage and AC voltage to achieve a given operating condition for different conditions of the coronode.

The behavior described by FIG. 3 may also be illustrated by plotting the DC shield voltage condition required to achieve a given DC current condition, as a function of the AC voltage. Such a plot is shown in FIG. 4. FIG. 4 shows the relationship between the DC shield voltage applied to the conductive shield 320, as a function of AC voltage applied to the coronode 310, to achieve a given DC charge current. As shown in FIG. 4, a DC charge current of 130 μA is used as an example. In general, the relationship between DC shield voltage and AC voltage is inverse, that is, to achieve a given DC current (130 μA), the required DC shield voltage decreases with increasing AC voltage. Higher AC voltages produce a plasma with a higher concentration of charged species, and therefore produce a lower impedance path. For a charging device in pristine condition, the relationship between DC shield voltage and AC rms voltage to produce the specified charge current may be as shown in curve C. For curve C, operating the charge device at AC rms voltage AC, achieves the predefined operating current at a DC voltage setting of $V_1$.

However, when the coronode 310 becomes contaminated, or the image forming device 100 is placed in a higher pressure situation, for example, the relationship between the DC shield voltage and AC rms voltage to produce the specified charge current may shift to curve D. If the coronode 310 is operated at the same AC rms voltage, $AC_1$, the DC shield voltage required to achieve the specified charge current may shift from $V_1$ to $V_2$. If the situation deteriorates further, the image forming device 100 may increase the DC shield voltage to a level exceeding the over-voltage level $V_3$. At this point, the image forming device 100 may cease to function properly or at all.

However, as also shown in FIG. 4, if the AC rms voltage is increased from $AC_1$ to $AC_2$, the voltage required to achieve the predefined operating current may remain at $V_1$ in spite of shifts in the operating behavior of the charging device. Shifts in the operating behavior may result from any of the previously discussed effects, such as changes in environmental conditions, changes in contamination level of the coronode 310, changes in positioning or condition of the transfer assist blade 370, or changes in positioning of the charging unit 300 relative to the photoconductive surface 340. Thus, a calibration procedure may be used to determine a minimum value of the AC rms voltage that allows the predefined operating current to be achieved at or below a target operating voltage $V_1$ in view of the current operating behavior.

Figure 5:
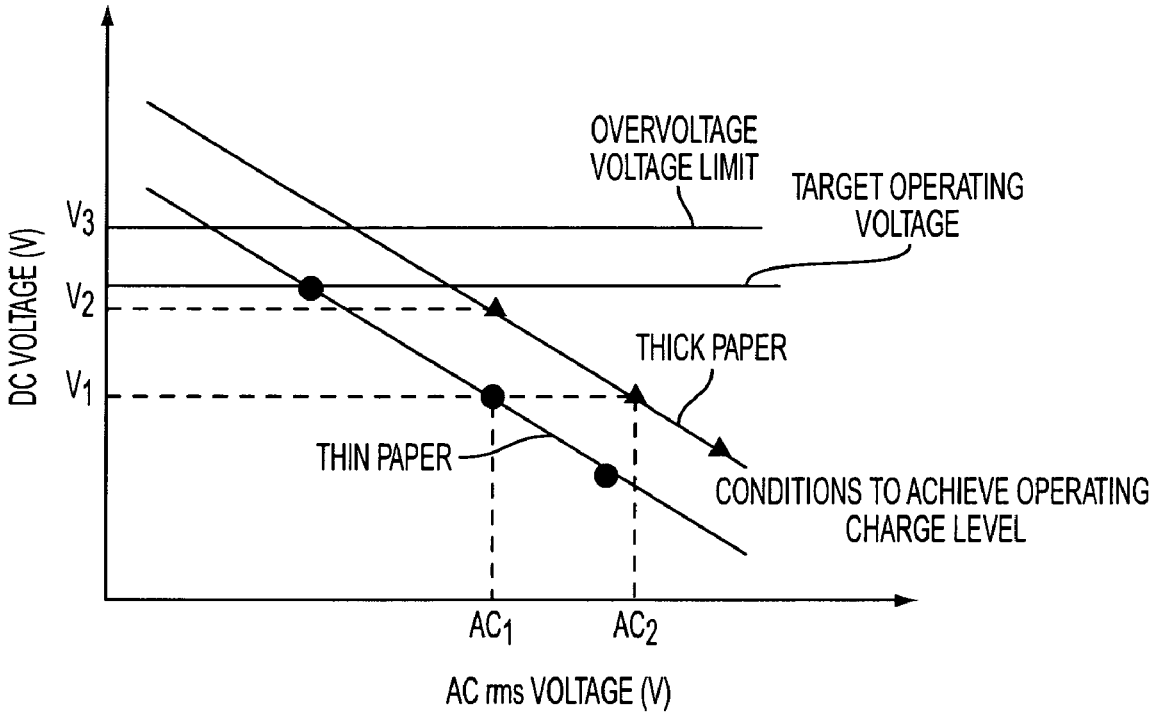
FIG. 5 shows exemplary relationships between the DC shield voltage and the AC voltage to achieve a given operating condition for different thicknesses of recording medium.

FIG. 5 shows the relationship between the DC shield voltage level and the AC rms voltage for achieving a predefined charge current for different thicknesses of recording medium. As shown in FIG. 5, a thicker recording medium effectively increases the impedance of the resistive path between the conductive shield 320 and the photoconductive surface 340. For at least this reason, the DC shield voltage level required to achieve a given charge current at a fixed AC rms voltage may increase or decrease based on the thickness of the recording medium. A thicker recording medium may, in general, increase the required DC shield voltage from, for example, $V_1$ to $V_2$, thereby reducing the headroom available before reaching an over-voltage threshold $V_3$.

Charging devices that use a grid 330 are generally referred to as scorotrons and a dicorotron charging device that uses a grid is generally referred to as a discorotron. The relationships between DC voltages, DC currents and AC voltages for discorotrons are similar to the ones described for dicorotrons. However, if a grid structure 330 is used, the DC voltage of interest is the voltage on the grid. The DC current of interest is still the net current that flows away from the charging device 300 toward the photoconductive surface 340. In a typical case, the grid 330 and shield 320 may be electrically connected to each other and to the DC power supply, as illustrated for example in FIG. 11, and then the DC current from the power supply is the DC current of interest as this is the net DC current that flows away from the charging device 300 toward the photoconductive surface 340. In other cases, the grid 330 may be connected to the voltage output of the DC supply, but the shield may be at substantially zero potential. In this case, as illustrated for example in FIG. 12, the DC current of interest is the difference between the DC current flowing to the grid 330 and the DC current flowing to the shield 320 as this current is the net DC current that flows away from the charging device 300 toward the photoconductive surface 340.

Instead of allowing the DC shield voltage level to increase dangerously close to the over-voltage threshold $V_3$, the image forming device 100 may perform a calibration procedure, for example, once per day at power-up, to detect changes in the ability of the coronode 310 to form the corona plasma 350.

Figure 6:
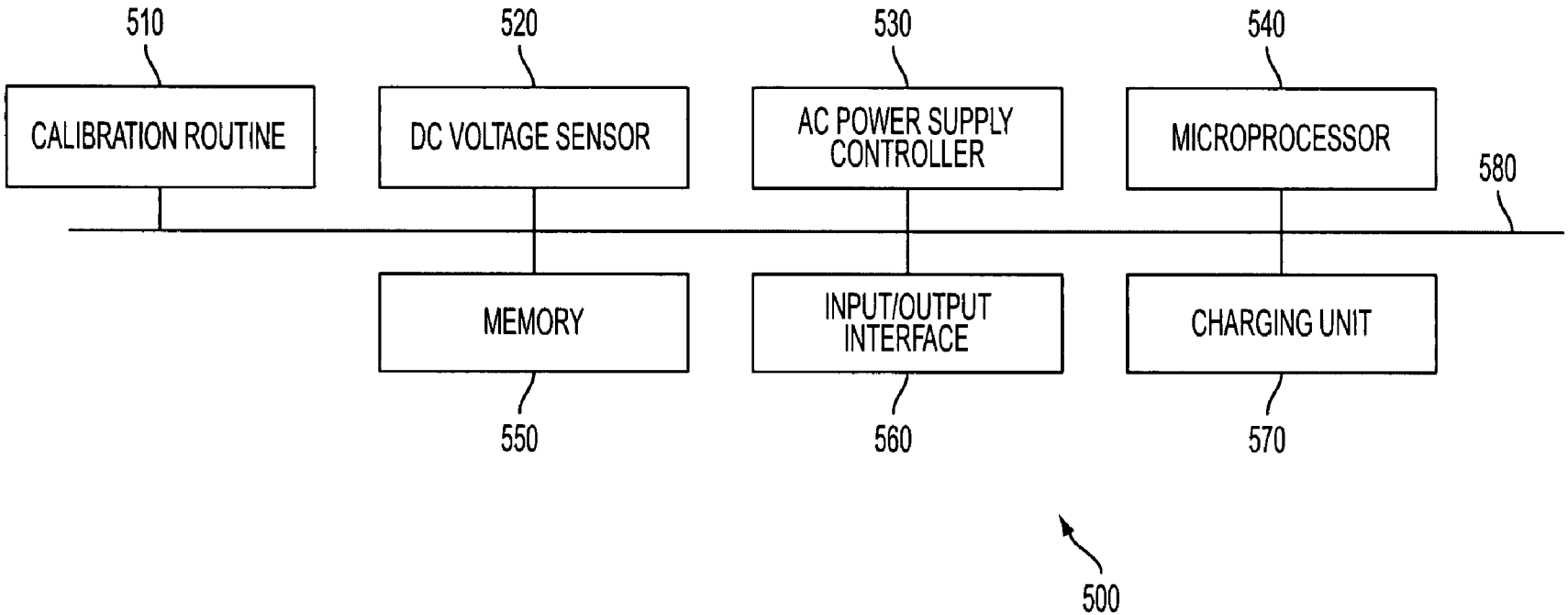
FIG. 6 shows an exemplary embodiment of a calibration system for use with the image forming device of FIG. 1.

An exemplary calibration system 500 is shown in FIG. 6. The calibration system may include a calibration circuit or routine 510, a microprocessor 540, an AC power supply controller 530, a DC shield voltage sensor 520, a memory 550, an input/output interface 560, and a charging unit 570. The foregoing components 510-570 may be coupled, for example, on a bus 580, or may be implemented as components of an application-specific integrated circuit (ASIC). Any combination of hardware and software may be used to implement the components of the calibration system 500 as illustrated in FIG. 6. It should be understood that the calibration system 500 may be embodied in a suitably programmed personal computer, for example, including the above-mentioned components. The calibration system 500 may also be integrated with the image forming device 100, such as a xerographic image forming device, to calibrate the voltages used in various charging units of image forming device 100.

The microprocessor 540 may invoke the calibration routine 510 upon power-up at the start of each work day, for example. Alternatively or additionally, the calibration routine 510 may be invoked when the image forming device 100 senses that the DC shield voltage has increased to some threshold level. Alternatively or additionally, the calibration routine may be invoked at any interval desired by a user or by a service engineer.

The calibration routine 510 may retrieve a target DC shield voltage level from memory 550. This target value may have been established during the design or manufacture of the image forming device 100, for example, to allow ample headroom for commonly encountered situations before reaching the over-voltage condition. For example, the target value may have been established in view of all stresses that are commonly encountered in the operation of image forming device 100, such as types of recording medium, atmospheric conditions, and the like. Furthermore, the target value may be a set of target values stored in memory 550 and selected by calibration routine 510 according to current operating conditions of the image forming device 100, such as atmospheric pressure, the type of recording medium being used, and/or even the age of the device. The target value may therefore be retrieved from a set of target values stored, for example, in a lookup table in memory 550. The predefined charge current requirement may also be stored in memory 550, for example, as a specification of the image forming device 100. The target value and the predefined charge current requirement may have been input to the calibration system 500 via input/output interface 560, for example.

The calibration routine 510 may apply the predefined charge current requirement to the charging unit 570, and may measure the DC shield voltage required to achieve this current, for example, using the DC voltage sensor 520. If the DC shield voltage is greater than the target value, the calibration routine 510 may increase the AC rms voltage applied to the coronode 310 by the AC power supply controller 530. The calibration routine 510 may again measure the DC shield voltage required to achieve the predefined charge current using the DC voltage sensor 520. If the DC shield voltage is again too high, the calibration routine 510 may continue to increase, for example, the AC rms voltage applied to the coronode 310, using the AC power supply controller 530. The calibration routine 510 may continue this process until the DC shield voltage measured by the DC voltage sensor 520 is at or below the target value. Thus, a preferred value of the AC rms voltage appropriate for the given day under the given conditions may be determined and may be stored in memory 550, for example, and used until the next calibration procedure is performed.

As described above, the preferred value of the AC rms voltage may also be a function of the recording medium thickness. The calibration system 500 may be used to determine a preferred AC voltage setting for different recording medium thicknesses as well. This determination may be used, in particular, for a transfer dicorotron, that applies charge to the backside of the recording medium at the image transfer station. Accordingly, to determine the preferred value of the AC rms voltage for a given recording medium thickness, a target DC shield voltage may be retrieved from memory 550, based on the given thickness of recording medium. As with the "no paper" case described above, the charging unit 570 may be configured to operate at the predefined charge current. The calibration routine 510 may initially apply a relatively low value of AC rms voltage to the AC power supply controller 530, which may apply this AC rms voltage to the coronode 310. The calibration routine 510 may then obtain the DC shield voltage measurement detected by the DC voltage sensor 520. If the measured DC shield voltage is above the target value, the calibration routine 510 may incrementally increase the AC rms voltage, and may apply incremented value to the coronode 310. The calibration routine 510 again measure the DC shield voltage level, and may determine if the level is at or below the target value. If so, the calibration routine 510 may store the value of the AC rms voltage in memory 550 as the preferred AC rms voltage. If not, the calibration routine 510 may again increase the AC rms voltage, continuing the process until the target DC shield voltage is reached.

Using the calibration system 500 described above, the image forming device 100 may operate at a minimum, or at least a reduced, AC rms voltage. By performing such calibration at regular, but perhaps infrequent intervals, the DC shield voltage may be prevented from approaching the over-voltage level.

With the dicorotron types of charging devices discussed, the target DC shield voltage may be, for example, 1000 to 5000 volts depending on the specific application of the charging device, and the lower bound of the AC rms voltage may be, for example, 5000 to 5500 volts rms. The increments by which the AC rms voltage is increased may be, for example, 200 volts per step. The frequency of the AC rms voltage signal may be, for example, about 4000 Hz. The over-voltage threshold for the image forming device 100 may be, for example, 6000 to 7500 volts.

If, during the course of any particular calibration, the calibration system detects that the required AC rms voltage is too close to an undesirable upper limit level, for example, stored in a lookup table, the calibration system may output a warning to the user that the required voltages are rising, and that maintenance of the image forming device 100 may be advised or required. The upper limit may be determined during product development as a value that causes unacceptable risk for problems such as acing between the coronode and nearby conductors such as the charging device shield. This limit may decrease with factors such as altitude, coronode wire ageing time and other factors that may be determined during product development. The lookup table may include different AC limit levels that may be compared to the AC rms level selected in the calibration step. For example, if the machine is at sea level, and the AC rms voltage exceeds about 7000 volts, arcing may occur between the coronode 310 and other conductive surfaces, such as the conductive shield 320 or the photoconductive surface 340. If the machine is at about 8000 feet altitude, a similar risk for arcing may occur at only 6000 volts rms. Similarly, if the charging device is relatively new or if a new coronode has recently been installed in the device, the AC voltage limit may be higher than, for example, when the charging device has been running in the machine for a long time, for example, one million print cycles. Parameters such as the atmospheric pressure may be measured with sensors in the machine so that the desired lookup table AC limit level may be, for example, automatically selected based on the sensor reading. Alternatively or additionally, parameters such as the altitude may be manually supplied to the lookup table. Similarly, other factors that influence the choice of the AC voltage limit may be automatically supplied to the lookup table using appropriate sensing or may be manually supplied. For example, when a new charging device, or a new coronode, is installed, the print count at install may be manually or automatically provided to the lookup table and the running print count information from a print count sensor may be provided so that the specific selection of the AC voltage limit may, for example, be changed to a new level depending on the number of prints run after the install of the new charging device hardware. Thus, the calibration routine may include a warning routine that outputs a warning to the user that the AC rms voltage is becoming too high for the particular conditions of the machine operation. Alternatively, the calibration routine 510 may automatically invoke a coronode cleaning routine or additionally may reduce the operating current of the image forming device 100 within some predetermined operating latitude range for the specific charging device determined during product development. Such a reduction in operating current may generally be a temporary approach if, for example, coronode cleaning was not sufficiently successful for reducing the AC voltage level, and a stronger warning may be issued to the user that further action may be required shortly.

Figure 7:
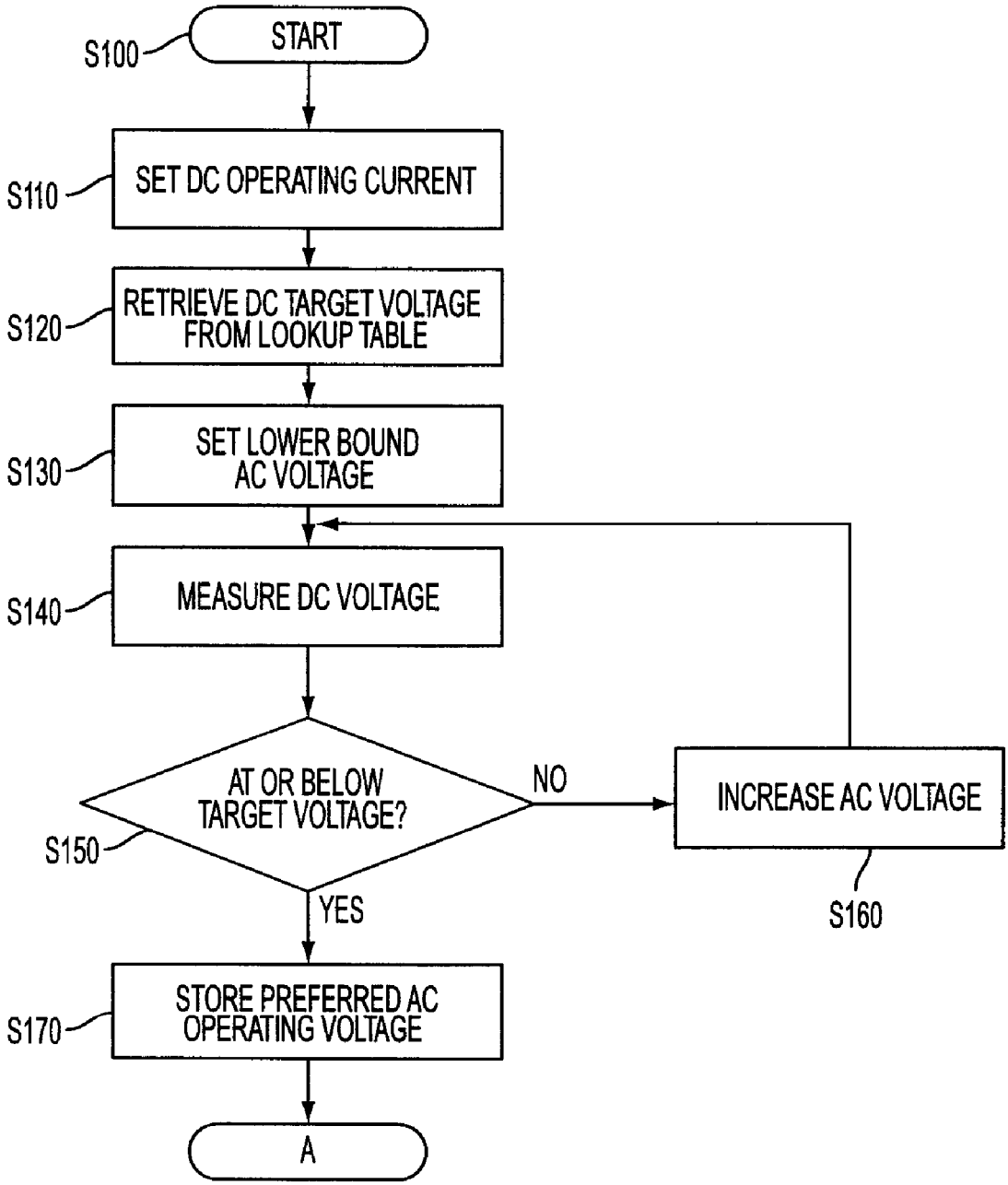
FIG. 7 is an exemplary flowchart illustrating a method of calibrating the AC voltage required to achieve a specified DC operating current.

FIG. 7 is a flowchart illustrating an exemplary method for performing the calibration routine. The method may begin in step S100 and continues to step S110, in which the DC operating current for the device may be set. In step S120, a target DC voltage level may be retrieved, from, for example, a lookup table stored in memory. In various exemplary embodiments, the target DC voltage may be, for example, 3000 volts. In step S130, a lower bound of an AC rms voltage range may be set for the device. In various exemplary embodiments, the lower bound of the AC rms voltage may be, for example, 5500 volts. In step S140, the DC shield voltage may be measured, as the shield voltage required to achieve the operating current established in step S110.

In step S150, a determination may be made whether the measured shield voltage is at or below the target voltage retrieved in step S120. If so, the process may continue to step S170, wherein the current value of the AC voltage may be stored as the preferred value of the AC voltage. If the shield voltage is not at or below the target DC voltage in step S150, the AC rms voltage may be increased in step S160, for example, incrementally. In various exemplary embodiments, the AC rms voltage may be increased by about 200 volts per step S160. The process may then return to step S140, in which the DC shield voltage may again be measured with the incremented AC rms voltage. If the DC shield voltage is at or below the target value in step S150, the current value of the AC voltage may be stored as the preferred value of the AC voltage in step S170.

The process may then continue to step S180, in which a determination may be made whether the level of the AC rms voltage is approaching or exceeding a threshold warning level. In various exemplary embodiments, the threshold warning level may be, for example, 6500 volts. If so, the method may output a warning to the user in step S190 that the AC rms voltage level may be becoming too high, and that preventive maintenance may be advised or required. If the AC rms voltage is not approaching or exceeding the threshold voltage level, the method may apply the AC rms voltage to the charging unit in step S200. Images may then be printed in step S210. The process may end in step S220.

Figure 8:
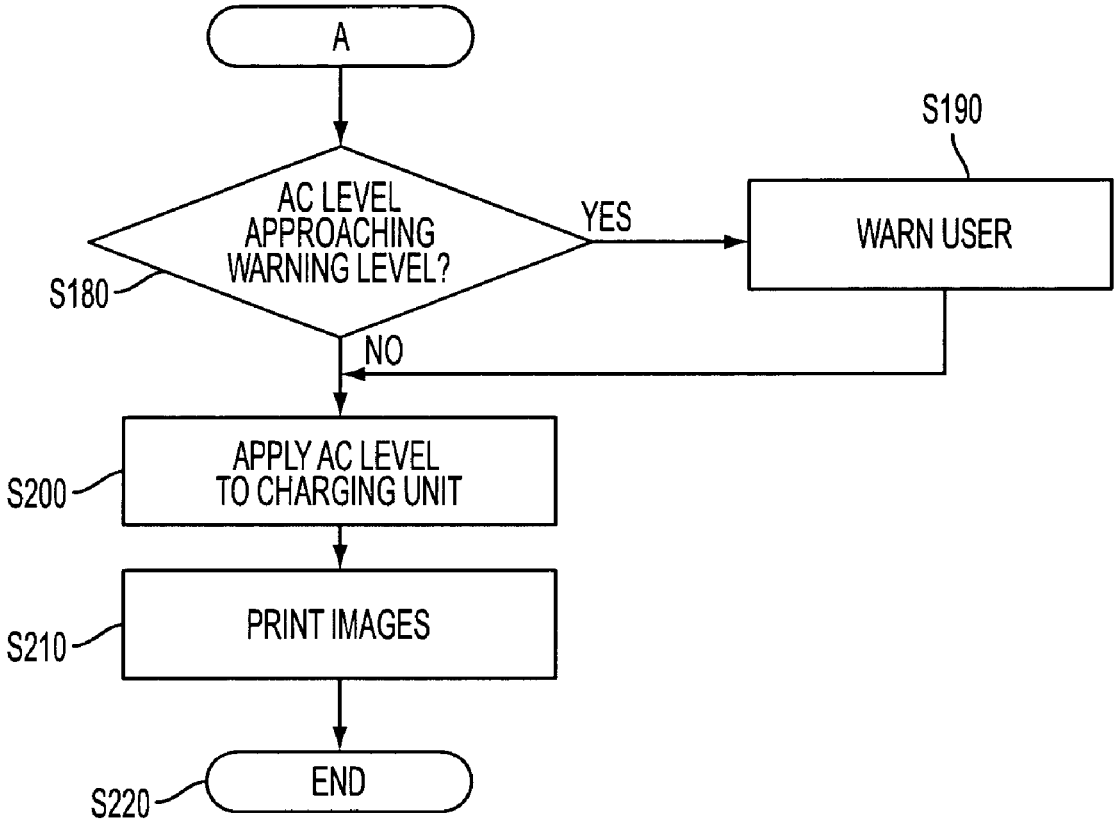
FIG. 8 is an exemplary flowchart illustrating an exemplary method that includes providing a warning to the user.

The method illustrated in FIGS. 7 and 8 may be appropriate for charging units operating in portions of the image forming path in which no recording medium is carried on the photoconductive belt 110, such as dicorotrons 130, 180 and 260 shown in FIG. 1. However, for transfer dicorotron 240 located at the transfer station of image forming device 100 where recording medium is present on the photoconductive belt 110, method shown in FIG. 9 may be more appropriate.

Figure 9:
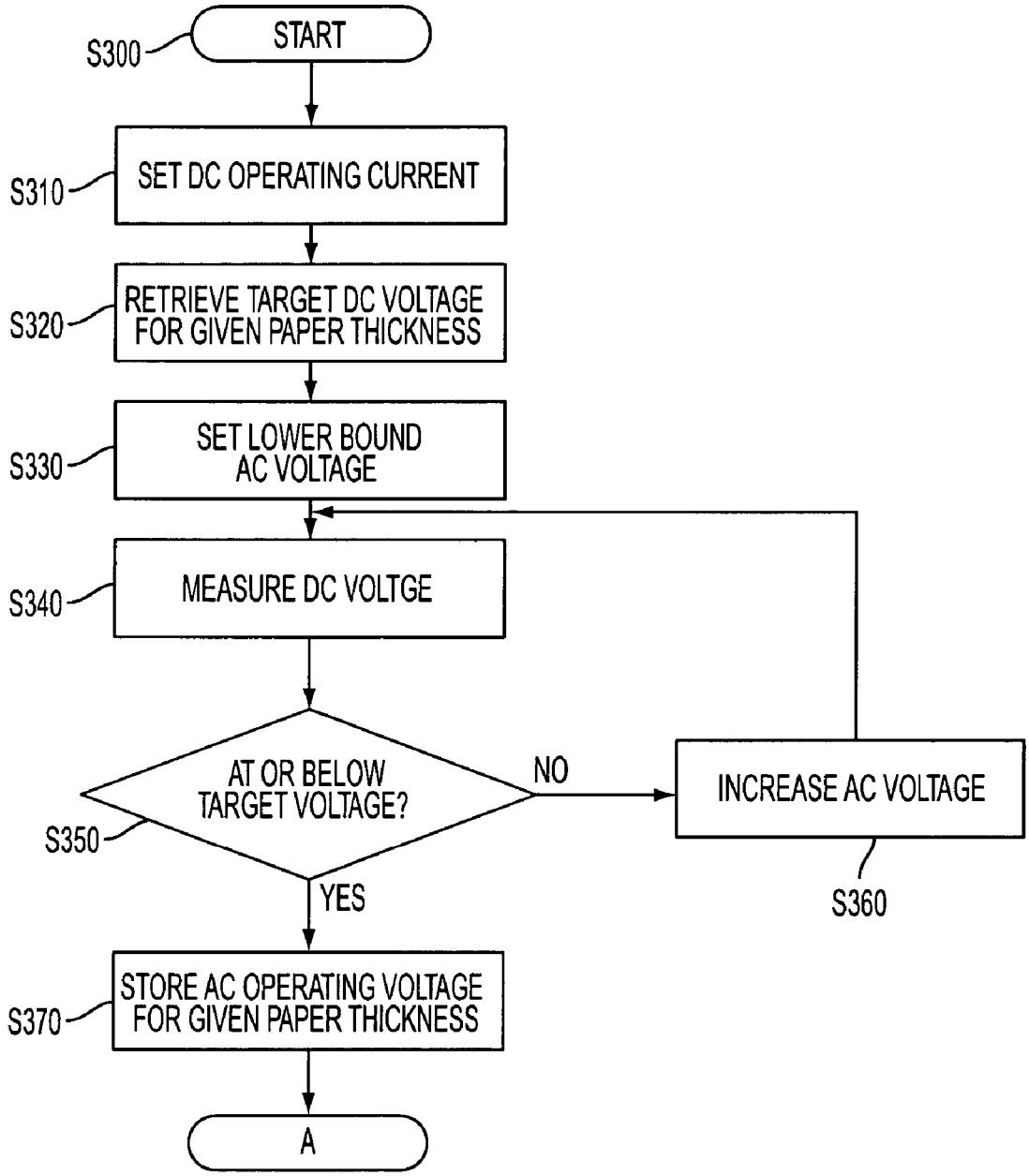
FIG. 9 is an exemplary flowchart illustrating a method of obtaining a value for the AC operating voltage for a given recording medium thickness.

The method shown in FIG. 9 may begin in step S300 and may proceed to step S310, in which the DC operating current for the device may be set. In step S320, the target DC shield voltage may be retrieved from memory, as appropriate for a given recording medium thickness. More generally, although medium thickness is usually a large factor for selecting the target DC shield voltage, the specific media type (e.g., paper, coated paper (single/double sided), transparency materials, different manufacturers, and the like) may also be a factor. Thus, information about the type of media is being used may be supplied to the lookup table so that a specific target DC shield voltage for that specific media type may then be selected. Also, factors such as the relative humidity and temperature may be automatically measured in a machine and added to the lookup table information to select different target DC shield voltage levels depending on the environmental range during printing. The specific target DC shield voltage for specific media and at selected environmental range increments may be readily predetermined during testing in product development. In step S330, a lower bound for AC rms voltage on the coronode may be set. In step S340, the DC shield voltage level may be measured. In step S350, a determination may be made whether the measured DC shield voltage level is at or below the target level. If so, the process may proceed to step S370, wherein the current AC rms voltage level may be stored.

If the DC shield voltage level exceeds the target level in step S350, the AC rms voltage level may be increased, for example, incrementally, in step S360. The process may then return to step S340, in which the DC shield voltage may again be measured. If the DC shield voltage is not at or below the target level in step S350, the current value of the AC rms voltage may be stored as the preferred AC rms voltage level for the given recording medium thickness in step S370. The process may then proceed, for example, to continue with steps as described above with respect to FIG. 8.

Figure 10:
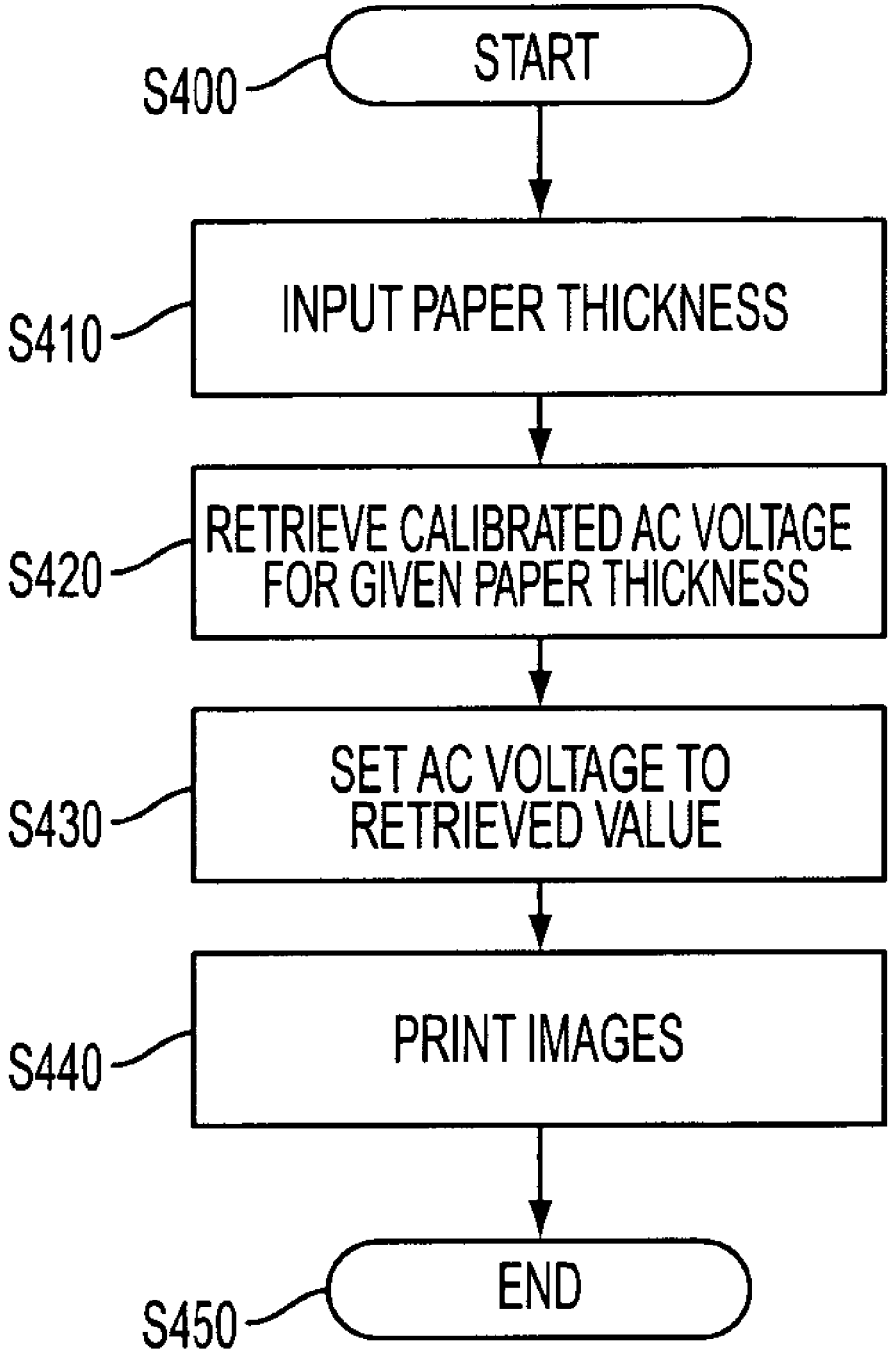
FIG. 10 is an exemplary flowchart illustrating a method of printing a number of images using calibrated values for the AC operating voltage.

FIG. 10 is a flowchart illustrating an exemplary method of printing images using calibration routines, for example, as described with respect to FIGS. 7-9. The method of FIG. 10 may be appropriate for large printing runs using a particular recording medium stock, for example. The process may begin in step S400 and may proceed to step S410, in which the recording medium thickness for the ensuing run may be input by the user or by a print job according to a software program. Based on the input recording medium thickness, the process may access a lookup table to retrieve an appropriate preferred value for the AC rms voltage for the particular recording medium thickness. The preferred value for the AC rms voltage may have been previously established and stored by the calibration routine of FIG. 9, for example. The process may then proceed to step S430, in which the AC rms voltage may be set to the retrieved level. Images may then be printed in step S440, using the preferred value of the AC rms voltage. The process may end in step S450.

Various alternatives, modifications, variations, improvements, and/or substantial equivalents, whether known or that are or may be presently unforeseen, may become apparent upon reviewing the foregoing disclosure. For example, not all of the steps indicated in FIGS. 7-10 may be required for calibration. For example, images may not be printed, and therefore steps S220 and S440 may be omitted from FIGS. 8 and 10, respectively. While the exemplary embodiments described above relates to a highlight color image forming device, this should be understood to be illustrative only, as the systems and methods may apply to any number of alternative image forming devices, or any other device that uses a charging unit, such as single color, black-only, or multiple full-color image forming devices that may, for example, include the use of intermediate transfer steps.

Figure 11:
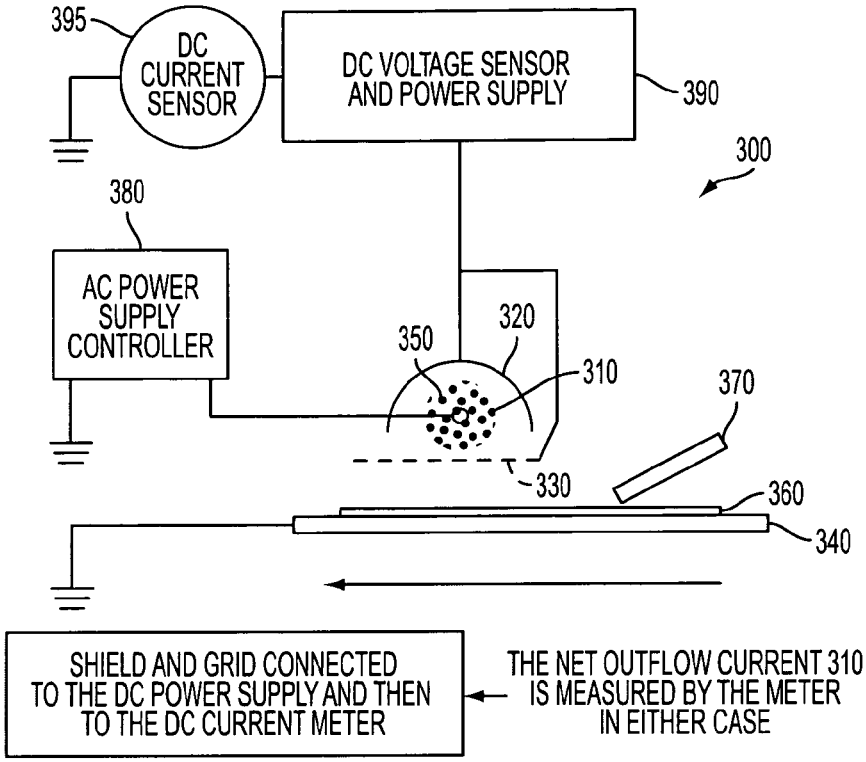
FIGS. 11-14 illustrate additional exemplary arrangements.
Figure 12:
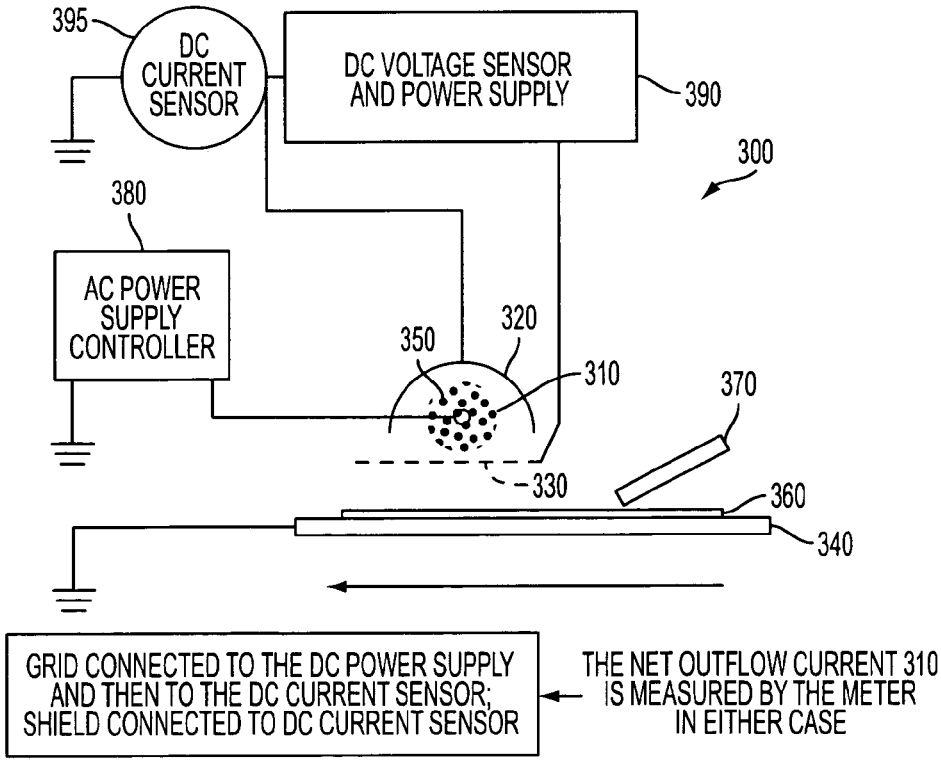
Figure 13:
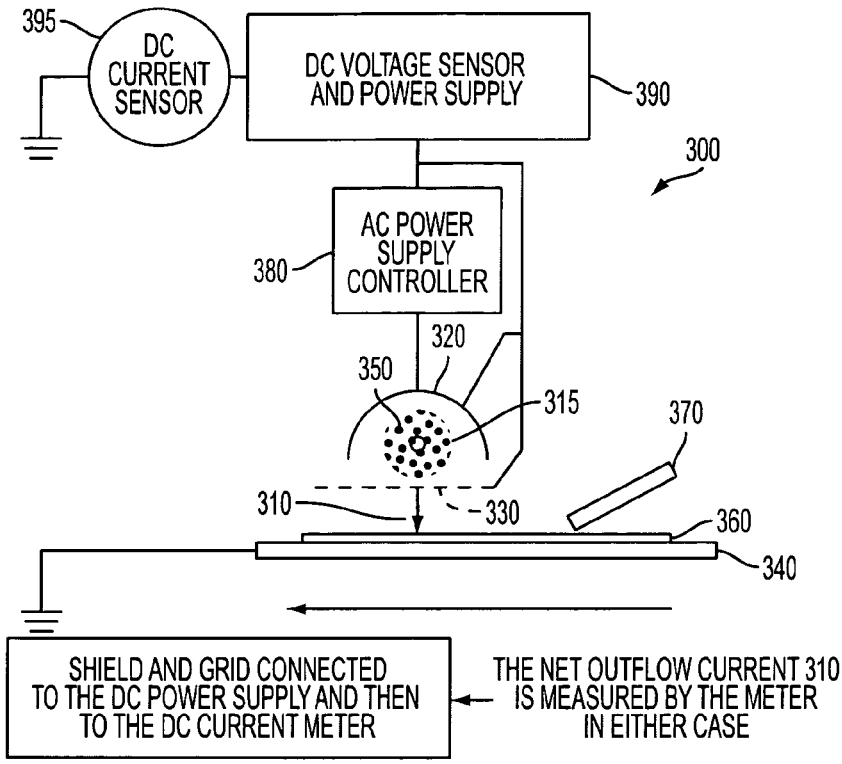
Figure 14:
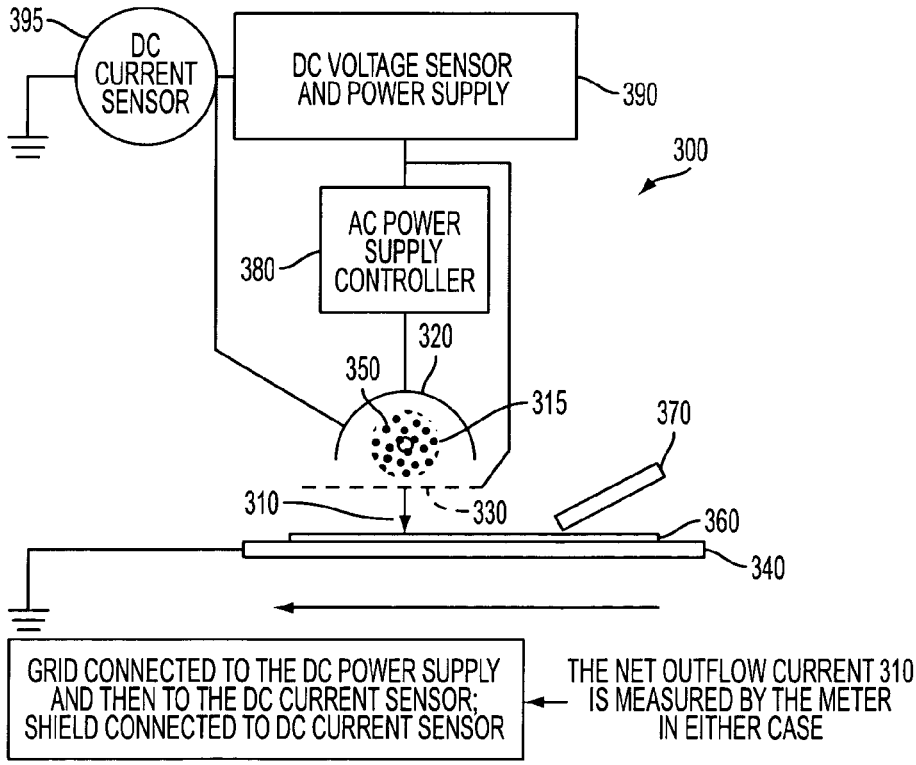

With other types of charging devices that employ both AC and DC potentials, there are similar relationships between AC voltages, DC currents and DC voltages as discussed for the dicorotron examples, but there may be some small differences. For example, FIGS. 11-14 show various exemplary embodiments of other types of charging devices with different power supply arrangements. In these exemplary embodiments, the coronode 315 may be a conductor such as a thin metal corotron wire or an array of sharp conductive pins. Unlike a dicorotron type of charging device, DC current may flow from the coronode itself. In FIG. 11, the DC voltage of interest is the DC voltage offset applied to the coronode 315 and, as with dicorotrons, the relationships of interest are between the DC voltage 390, the AC voltage 380 applied to the coronode 315, and the DC current 395. Slightly different arrangements of the DC power supply connections are shown in FIGS. 12-14. Like the dicorotrons, the DC current 395 of interest for these types of charging devices is the net DC current that flows away from the charging device toward the photoconductive surface 340. However, as illustrated by these examples, the specific approach used to obtain this current may depend on the specific power supply configuration used with the charging device. For example, the shield 320 may be electrically connected to the low voltage side of the DC power supply and a current monitor 395 may be connected between the low side of the power supply and the typically grounded substrate of the photoconductor 340. In this way, the DC current measured by the current monitor 395 is the difference between the DC current flowing from the coronode 315 and the DC current flowing to the shield 320, which is the net current 310 flowing away from the charging device 301 toward the photoconductor 360. It will be understood that the current monitor 395 in the power supply arrangements in FIGS. 11-14 may also measure the net current 310 flowing away from the charging device 302 toward the photoconductor 360. It will also be understood that many other power supply arrangements may be used to obtain the desired net current 310 flowing away from the charging device toward the photoconductor 360. Because the relationships between the AC voltages 380, the DC voltages 390 and the DC currents 395 may be very similar to those for dicorotrons, all of the AC calibration setup approaches discussed above may apply for these and other types of charging devices that employ AC and DC biases.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. An apparatus for calibrating a charging unit, comprising:

a microprocessor that executes a calibration routine that sets a value of an operating current;

a DC voltage sensor that senses a DC voltage in a charging unit required to achieve the set operating current;

a DC power supply controller that adjusts the DC voltage to deliver the set operating current;

an AC power supply controller that applies an AC voltage to the charging unit, wherein when the DC voltage is above an over voltage value the microprocessor increases the AC voltage; and wherein when the DC voltage is below the over voltage value the DC power supply controller adjusts to maintain the set operating current, the DC voltage sensor senses a new DC voltage that achieves the set operating current.

2. The apparatus of claim 1, wherein the charging unit further comprises:

a coronode; and a conductive shield, wherein the AC power supply controller applies the AC voltage to the coronode and the DC voltage sensor senses the DC voltage on the conductive shield.

3. The apparatus of claim 2, further comprising a conductive grid disposed between the coronode and a photoconductive surface.

4. The apparatus of claim 2, further comprising:

a memory that stores the target value.

5. The apparatus of claim 4, wherein the target value comprises a plurality of target values corresponding to a plurality of recording medium thicknesses.

6. The apparatus of claim 5, wherein each of the plurality of target values corresponds to a recording medium thickness and at least one other operating condition of the charging unit.

7. The apparatus of claim 6, wherein the at least one other operating condition of the charging unit comprises at least one of a relative humidity and an atmospheric pressure.

8. The apparatus of claim 4, wherein the memory further stores an incremented value of the AC voltage at which the target value is measured by the DC voltage sensor.

9. A xerographic image forming device comprising the apparatus of claim 1.

10. A method of calibrating a charging unit, comprising:

setting a value of an operating current;

obtaining a DC voltage over voltage value adjusting and measuring a DC voltage value on a conductive shield required to achieve the set operating current value;

incrementing an AC voltage level applied to a coronode when the DC voltage value is above the over voltage value; and adjusting and measuring the DC voltage value on the conductive shield to maintain the set operating current when the DC voltage value is below the over voltage value.

11. The method of claim 10, further comprising:

issuing a warning when the incremented AC voltage approaches a predefined threshold level.

12. The method of claim 10, further comprising storing the incremented AC voltage level at which the measured value is at or below the target DC voltage level.

13. The method of claim 12, further comprising:

retrieving the stored incremented AC voltage level; and setting an AC voltage level of the charging unit to the retrieved incremented AC voltage level.

14. The method of claim 13, further comprising forming an image using the set AC voltage level.

15. The method of claim 10, further comprising inputting a designated recording medium thickness.

16. The method of claim 15, wherein obtaining the target DC voltage level comprises obtaining a target DC voltage corresponding to the designated recording medium thickness.

17. The method of claim 15, further comprising determining an environmental condition.

18. The method of claim 17, wherein obtaining the target DC voltage level comprises obtaining a target DC voltage corresponding to the designated recording medium thickness and the determined environmental condition.

19. The method of claim 17, wherein the environmental condition comprises at least one of relative humidity and atmospheric pressure.

20. An apparatus for calibrating a charging unit, comprising:

means for setting a value of an operating current;

means for obtaining a DC voltage over voltage value;

means for adjusting and measuring a DC voltage value on a conductive shield required to achieve the at least one set value;

means for incrementing an AC voltage level when the DC voltage value is above the over voltage value; and adjusting and measuring the DC voltage value on the conductive shield to maintain the operating current when the DC voltage value is below the over voltage value.

* * * * *